US012357062B2

(12) United States Patent
Keller et al.

(10) Patent No.: US 12,357,062 B2
(45) Date of Patent: Jul. 15, 2025

(54) BRACELET CLASP

(71) Applicant: ETA SA Manufacture Horlogère Suisse, Grenchen (CH)

(72) Inventors: Adrien Keller, Neuchâtel (CH); Paulo Bravo, Marin-Epagnier (CH); Tim Grosjean, Bienne (CH)

(73) Assignee: ETA SA MANUFACTURE HORLOGÈRE SUISSE, Grenchen (CH)

( * ) Notice: Subject to any disclaimer, the term of this patent is extended or adjusted under 35 U.S.C. 154(b) by 0 days.

(21) Appl. No.: 18/500,458

(22) Filed: Nov. 2, 2023

(65) Prior Publication Data

US 2024/0206604 A1 Jun. 27, 2024

(30) Foreign Application Priority Data

Dec. 22, 2022 (EP) ..... 22216204

(51) Int. Cl.
*A44C 5/24* (2006.01)

(52) U.S. Cl.
CPC ..... *A44C 5/24* (2013.01)

(58) Field of Classification Search
CPC .... A44C 5/24; Y10T 24/2155; Y10T 24/2143
See application file for complete search history.

(56) References Cited

U.S. PATENT DOCUMENTS 1,641,372 A * 9/1927 Chilson ..... A44C 5/246 24/71 J
1,688,090 A * 10/1928 Prestinari ..... A44C 5/246 63/5.1
1,821,507 A * 9/1931 Gammell ..... A44C 5/24 24/71 J
1,829,493 A * 10/1931 Armbrust ..... A44C 5/24 63/5.1
1,832,734 A * 11/1931 Prestinari ..... A44C 5/24 24/71 J (Continued)

FOREIGN PATENT DOCUMENTS

CH 703 294 A2 12/2011
CH 705642 A2 * 4/2013 ..... A44C 5/0069

(Continued)

OTHER PUBLICATIONS

European Search Report for 22 21 6204.2 dated May 15, 2023.

*Primary Examiner* — Jason W San
*Assistant Examiner* — Louis A Mercado
(74) *Attorney, Agent, or Firm* — Sughrue Mion, PLLC

(57) ABSTRACT

A bracelet clasp of the folding clasp type including a base element (10) whose first and second long sides are formed respectively of first (1) and second (2) spars, at least one leaflet (3, 4) which is pivotable and articulated on the first and/or the second short side of the base element (10), and at least one cover (5, 6) pivoting and articulated on the at least one leaflet (3, 4). The base element (10) includes first (11) and second (12) openings joined to the first (1) and second (2) spars so that they constitute the flexible member, a pressure exerted simultaneously on each of the spars (1, 2) in a direction transverse to the clasp leading to an elastic deformation of the spars (1, 2) and to the unbolting of the at least one cover (5, 6) of the base element (10) to allow the wearer to open the clasp.

12 Claims, 3 Drawing Sheets

(56) References Cited

U.S. PATENT DOCUMENTS

| | | | | | |
|---|---|---|---|---|---|
| 1,861,700 | A * | 6/1932 | Johnson | A44C 5/24 | 224/176 |
| 1,902,535 | A * | 3/1933 | Anderson | A44C 5/24 | 24/71 J |
| 1,920,739 | A * | 8/1933 | Bernard | A44C 5/24 | 24/71 J |
| 1,985,836 | A * | 12/1934 | Prestinari | A44C 5/246 | 24/71 J |
| 2,444,360 | A * | 6/1948 | Mauch | A44C 5/246 | 24/71 J |
| 3,550,216 | A * | 12/1970 | Gandleman | A44C 5/243 | 24/71 J |
| 5,485,659 | A * | 1/1996 | Kashikie | A44C 5/246 | 24/71 J |
| 11,678,725 | B2 * | 6/2023 | Giger | A44B 11/223 | 24/629 |

FOREIGN PATENT DOCUMENTS

| | | | | |
|---|---|---|---|---|
| CN | 103096752 | A | 5/2013 | |
| CN | 109 965 464 | A | 7/2019 | |
| EP | 1925227 | A1 * | 5/2008 | A44C 5/24 |
| FR | 2 782 250 | A1 | 2/2000 | |
| JP | S63-065802 | A | 3/1988 | |
| WO | 2020/225654 | A1 | 11/2020 | |

* cited by examiner

BRACELET CLASP

CROSS REFERENCE TO RELATED APPLICATIONS

This application claims priority to European Patent Application No. 22216204.2 filed Dec. 22, 2022, the entire contents of which are incorporated herein by reference.

TECHNICAL FIELD OF THE INVENTION

The invention relates to the field of clasps of the folding clasp type whether it is equipped with two leaflets or a single leaflet, this or these leaflets being articulated on a base element.

TECHNOLOGICAL BACKGROUND

A clasp of the folding buckle type is known from the prior art, said clasp comprising a substantially rectangular base element whose first and second long sides are formed respectively of first and second spars, and first and second leaflets which are pivotable and articulated on first and second sides of said base element, said leaflets being arranged to be folded over said base element and maintained thereon in response to an elastic device associated with a bolting and unbolting mechanism affecting said base element and said leaflets for respectively allowing said first and second leaflets to be hooked to said base element then unhooked.

Document EP 1 925 227 discloses a clasp formed of a base and two leaflets arranged to be folded over the base and maintained thereon in response to an elastic device composed of one or two coil springs.

To avoid this or these springs and simplify the construction of the clasp, document CH 703294 proposes a clasp composed of a base element on which two leaflets can be folded down and maintained hooked by acting on the elasticity contained in the spars forming the base element. By pressing on push-pieces formed integrally with the spars, the leaflets are freed from any hooking and the clasp can be opened.

The solution proposed by document CH 703294 does not allow to ensure good constructive rigidity to the base element while giving the spars forming same the elasticity necessary for the proper retention of the leaflet on the base element and allowing the release of said leaflets when a force is exerted on said spars.

SUMMARY OF THE INVENTION

A purpose of the invention is in particular to overcome the various disadvantages of the clasps of the prior art.

More specifically, a purpose of the invention is to provide a clasp of simple and reliable construction while having good rigidity to avoid involuntary opening.

For this purpose, the invention relates to a bracelet clasp of the folding clasp type comprising a base element whose first and second long sides are formed respectively of first and second spars, at least one leaflet which is pivotable and articulated on the first and/or the second short side of the base element, and at least one cover pivoting and articulated on the at least one leaflet, the at least one cover being arranged to be folded over the base element and maintained thereon in response to a flexible member associated with a bolting and unbolting mechanism affecting the base element and the at least one cover to allow the at least one cover to be hooked to the base element then unhooked.

According to the invention, the base element comprises first and second openings joined to the first and second spars so that they constitute the flexible member, a pressure exerted simultaneously on each of the spars in a direction transverse to the clasp leading to an elastic deformation of the spars and to the unbolting of the at least one cover of the base element to allow the wearer to open the clasp.

In accordance with other advantageous variants of the invention:

- the bolting and unbolting mechanism comprises at least first and second hooks carried by the at least one cover, the at least first and second hooks being arranged to be clipped respectively on at least first and second bolts carried by the first and second spars;
- the first and second spars respectively carry first and second push-pieces;
- the first and third bolts are placed next to each other on either side of the first push-piece, and the second and fourth bolts are placed on either side of the second push-piece;
- the first and second openings have a length less than the length of the base element and greater than the total length of the push-pieces and the bolts;
- the first, second, third and fourth bolts, and the first and second push-pieces form an element in one-piece with the base element;
- the clasp comprises support elements disposed on the spars and arranged to cooperate with ribs when pressure is exerted on the push-pieces, so as to limit the maximum travel for the push-pieces and limit the deformation of the spars so as not to exceed the plastic deformation threshold;
- the ribs are integral with the base element and formed in the immediate vicinity of the openings;
- the support elements are integral with the spars and placed on the back of the push-pieces;
- the support elements each have a lower inclined plane oriented towards the inside of the clasp, the lower inclined plane being arranged to cooperate with the ribs;
- the support elements each comprise an upper inclined plane oriented towards the outside of the clasp and arranged to cooperate with the covers;
- the base element, the first and second leaflets, and the first and second covers are made of a ceramic-filled plastic material;
- one of the ends of the first cover is fixed to a first strand or link of the bracelet and one of the ends of the second cover is fixed to a second strand or link of the bracelet.

The invention also relates to a bracelet equipped with a clasp in accordance with the invention.

BRIEF DESCRIPTION OF THE FIGURES

Other features and advantages of the invention will appear upon reading the following detailed description given by way of non-limiting example, with reference to the appended drawings wherein.

DETAILED DESCRIPTION OF THE INVENTION

Figure 1:
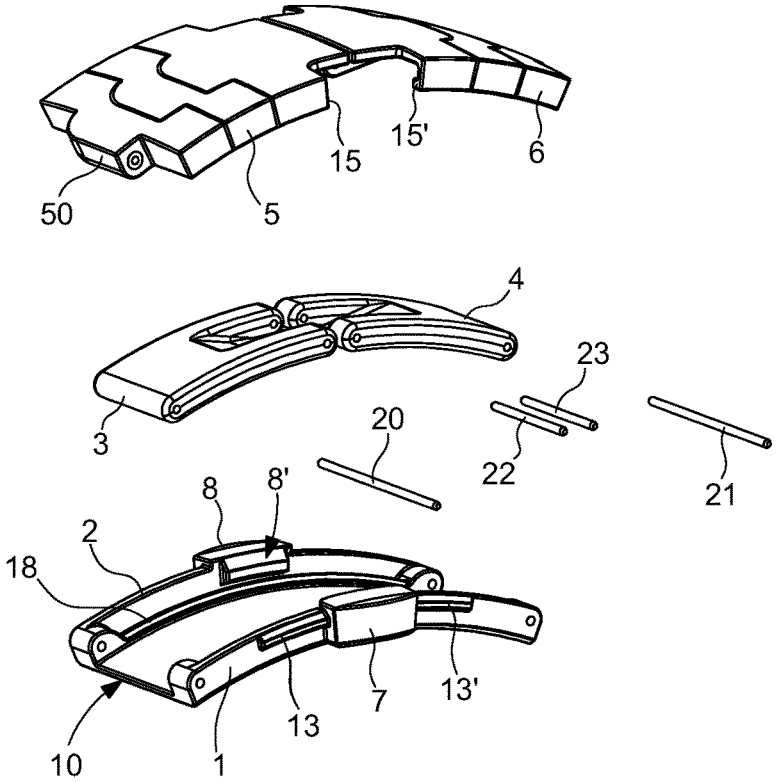
FIG. 1 shows an exploded perspective top view of a clasp according to a first embodiment of the invention.
Figure 2:
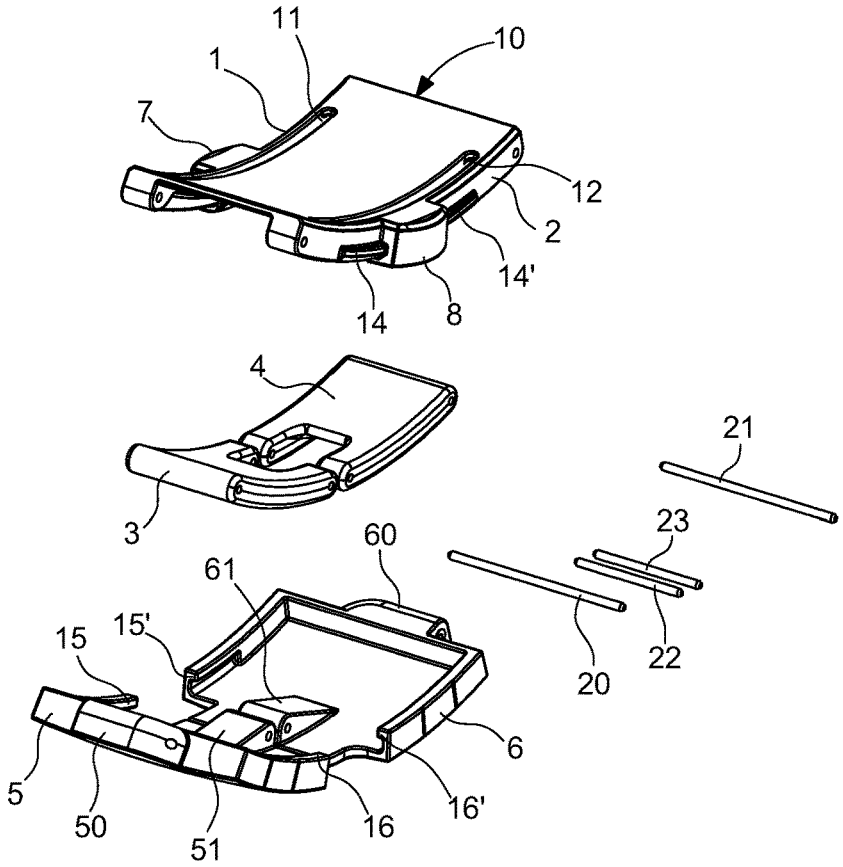
FIG. 2 shows an exploded perspective bottom view of the clasp according to a first embodiment of the invention.
Figure 3:
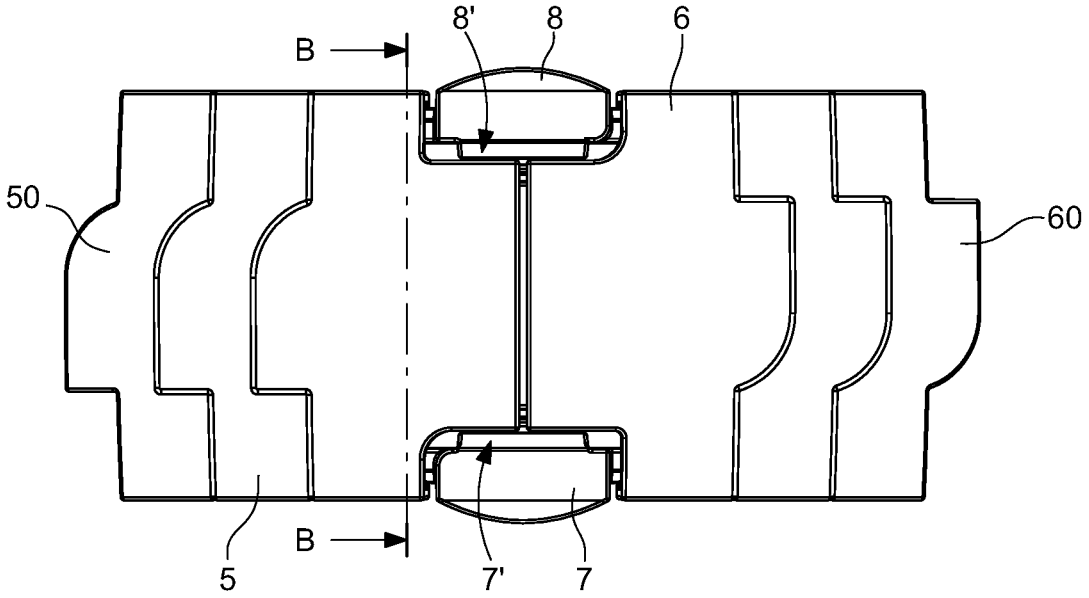
FIG. 3 shows a top view of a clasp according to a first embodiment of the invention in the closed position.

FIGS. 1 and 2 are exploded perspective views of the bracelet clasp of the folding clasp type.

In the remainder of the description, the term lower part means the part of the clasp which is arranged to be against the wearer's wrist, and the term upper part means the part of the clasp which is arranged to be accessible from the outside by the wearer.

The clasp comprises a substantially rectangular base element 10. As illustrated, the base element 10 has a slight curvature so as to adapt to the curvature of the wearer's wrist.

The base element 10 comprises first and second long sides formed respectively by first 1 and second 2 spars. The clasp also comprises first 3 and second 4 leaflets which are pivotally mounted and articulated respectively on the first and second short sides of the base element 10 around first 20 and second 21 bars.

Figure 4:
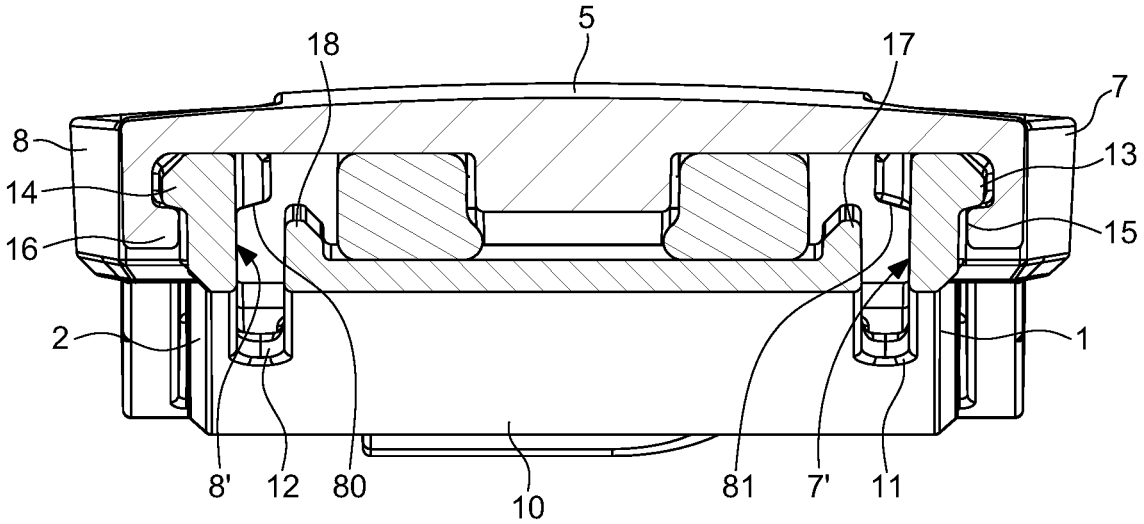
FIG. 4 shows a sectional view of a clasp according to a first embodiment of the invention along the line B-B of FIG. 3.

The leaflets 3 and 4 are arranged to be folded over the base element 10 and more particularly inside the base element 10 as illustrated in FIG. 4.

The clasp also comprises first 5 and second 6 covers which are pivotable and articulated respectively on the first and second leaflets 3 and 4 around bars 22, 23 passing through connecting elements 51, 61 integral with the covers, the covers 5 and 6 being arranged to be folded over the base element 10.

The covers 5 and 6 are maintained in the folded position on the base element 10 in response to an elastic device associated with a bolting and unbolting mechanism affecting the base element 10 and the covers 5, 6 to respectively allow the first 5 and second 6 covers to be hooked to the base element 10 then unhooked.

According to the invention, the base element 10 comprises first 11 and second 12 openings joined to the first 1 and second 2 spars, and positioned at the base of the latter.

Thanks to these openings 11, 12, the spars 1, 2 form the flexible member, a pressure exerted simultaneously on each of the spars 1, 2 leads to an elastic deformation of the spars 1, 2 and to the unbolting of the covers 5, 6 of the base element 10.

As shown in FIGS. 1 and 2, the openings 11, 12 have an oblong shape to facilitate their machining in the base element 10. Other shapes, such as a rectangular, circular, oval or else elliptical shape are obviously achievable.

The bolting and unbolting mechanism is implemented respectively to hook the first 5 and second 6 covers on the base element 10, and unhook the first 5 and second 6 covers from the base element 10. As can be seen in FIGS. 1 and 2, the bolting and unbolting mechanism comprises first 15 and second 16 hooks carried by the first cover 5 and third 15' and fourth 16' hooks carried by the second cover 6, the first 15 and second 16 hooks being arranged to be bolted respectively by first 13 and second 14 bolts which are opposite each other and carried by the first and second spars 1, 2 and the third 15' and fourth 16' hooks being arranged to be bolted respectively by third 13' and fourth 14' bolts which are opposite each other and also carried by the first and second spars 1, 2.

The bolts 13, 13' and 14, 14' are respectively moulded on the first and second spars 1, 2 of the base element 10 so as to form a one-piece element and obtain a more rigid clasp. Preferably, the bolts are positioned on the upper part of the spars 1, 2.

It will be understood that lateral pressure exerted simultaneously on each of the spars 1 and 2 will bring together the bolts 13 and 14 as well as the bolts 13' and 14' to release respectively the hooks 15 and 16 integral with the first cover 5 and the hooks 15' and 16' integral with the second cover 6. The clasp is then being opened. To promote the manual action exerted on each of the spars, the first 7 and second 8 push-pieces are fixed respectively on the first 1 and second 2 spars.

Figure 5A:
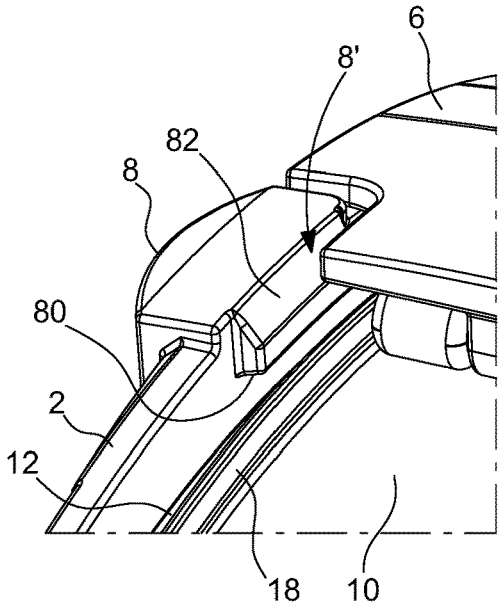
FIGS. 5*a* and 5*b* respectively illustrate detailed views of the interior and exterior of a clasp according to a first embodiment of the invention.
Figure 5B:
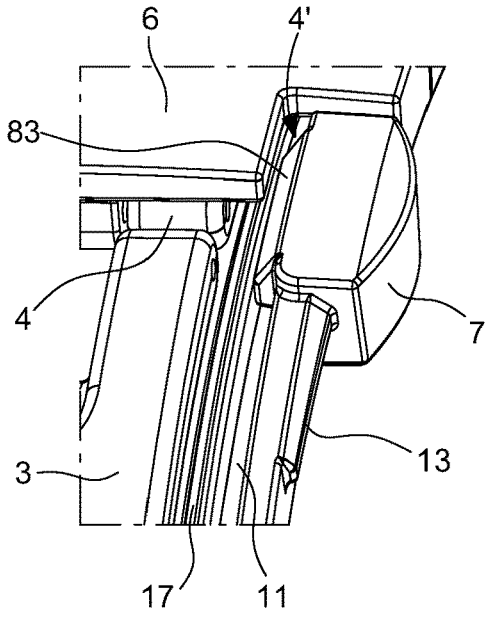

According to the invention, the bolts 13, 13' and 14, 14' have an evolving profile as visible in FIG. 5*b*. The thickness of the bolts gradually decreases as they move away from the push-pieces 7 and 8. Such an arrangement allows to compensate for the deformation of the spars which decreases moving away from the push-pieces.

As can be observed in FIG. 4, ribs 17, 18 are formed on the base element 10, in the immediate vicinity of the openings 11, 12. These ribs 17, 18 allow on the one hand to stiffen the base element 10, and on the other hand, to form stops for the spars 1 2 when the latter are deformed to unbolt the clasp.

Moreover, support elements 7', 8' are disposed on the back of the push-pieces, on the part of the spars facing the inside of the clasp. These support elements 7', 8' are arranged to cooperate with the ribs 17, 18 when pressure is exerted on the push-pieces 7, 8. The cooperation of the support elements and the spars 1, 2 with the ribs 17, 18 allows to delimit the maximum travel for the push-pieces and at the same time to limit the deformation of the spars 1, 2 so as not to exceed their plastic deformation threshold. When the wearer presses the push-pieces 7, 8, the spars 1, 2 are deformed and the lower vertical flanks of the spars rest against the ribs 17, 18 of the base element 10, the vertical flank of the ribs 17, 18 acting as a stop.

It is also noted that the support elements 7', 8' each have a lower inclined plane 80, 81 oriented towards the inside of the clasp, the lower inclined plane 80, 81 being arranged to cooperate with the upper portion of the ribs 17, 18 so as to guide the deformation of the spar and prevent it from twisting.

The support elements 7', 8' also allow to move the covers 5, 6 away from the base element 10 when the clasp is opened, the support elements 7', 8' comprising an upper inclined plane 82, 83 oriented towards the outside of the clasp and arranged to cooperate with the covers 5, 6. When the wearer presses the push-pieces 7, 8, the spars 1, 2 are deformed and the upper inclined plane 82, 83 of the support elements 7', 8' gradually guides the covers towards the outside of the base element 10 once the covers have been released from the bolts.

The first push-piece 7 and the second push-piece 8 are also moulded on the first and second spars 1, 2, and placed between each pair of bolts 13, 13' and 14, 14'.

Advantageously, the first 11 and second 12 openings have a length less than the length of the base element 10 and greater than the total length of the push-pieces and the bolts. Such a configuration allows to reduce the risks of accidental opening while allowing elastic deformation of the spars 1, 2 sufficient to unbolt the clasp easily when the wearer wishes to open the clasp.

To bolt the clasp, the wearer folds the covers 5, 6 towards the base element 10 so as to engage the hooks 15,16,15',16' with the bolts 13,14,13',14'. In order to facilitate the engagement of the hooks on the bolts, the latter have a slope which allows the covers to be guided progressively on the base element 10, then to deform and push back the spars 1,2 progressively as the covers 5,6 are pressed against the base element 10.

Once the hooks are engaged or clipped on the bolts, the spars 1,2 return to their rest position and the covers 5, 6 are bolted on the base element 10. Clipping the hooks on the bolts allows to obtain a notch perceptible by the wearer when closing the clasp and to ensure that the latter is properly bolted.

Although not shown in the figures, it goes without saying that a first strand or a first link of the bracelet is fixed to one of the ends 50 of the first cover 5 and that a second strand or second link of the bracelet is fixed to one of the ends 60 of the second cover 6.

The various elements constituting the clasp are made of a plastic material, and preferably of a plastic material filled with ceramic particles.

Other materials are possible for the manufacture of the clasp, such as metals or metal alloys for example.

Figure 6:
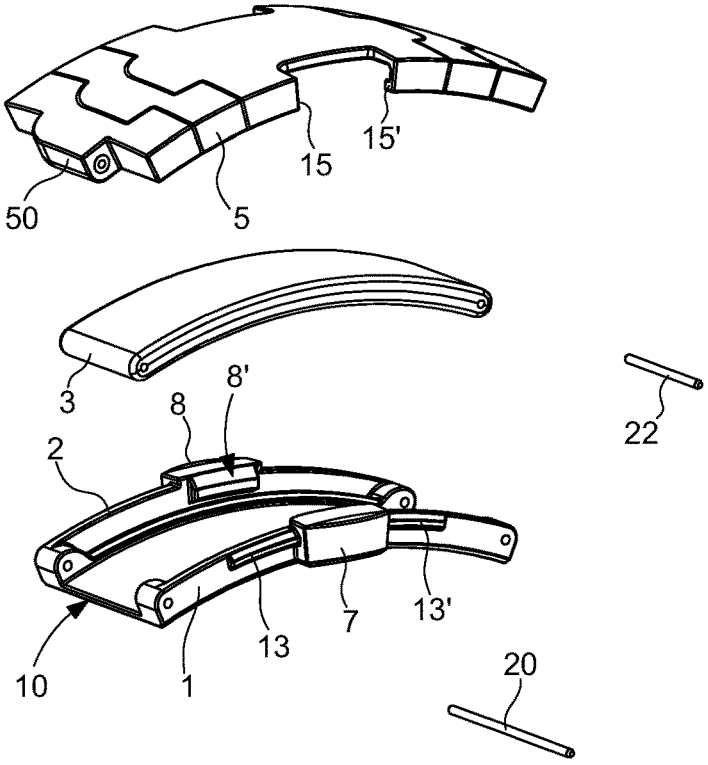
FIG. 6 shows an exploded perspective view of a clasp according to a second embodiment of the invention.

The person skilled in the art will have no particular difficulty using a similar clasp having a single leaflet and a single cover as illustrated in FIG. 6.

According to this embodiment illustrated in FIG. 6, the clasp comprises a base element 10 comprising first and second long sides formed respectively by first 1 and second 2 spars. The clasp comprises a leaflet 3 which is pivotally mounted and articulated on the first or second short side of the base element 10 around a bar 20.

The leaflet 3 is arranged to be folded over the base element 10 and more particularly inside the base element 10.

The clasp also comprises a cover 5 which is pivotable and articulated on the leaflet 3 around a bar 22 passing through a connecting element integral with the cover, the cover being arranged to be folded over the base element 10. A strand or link is fixed to the base element 10 and another strand or link is fixed to one of the ends 50 of the cover.

The cover is maintained in the folded position on the base element 10 in response to an elastic device associated with a bolting and unbolting mechanism affecting the base element 10 and the cover to allow the cover to be hooked to the base element 10 then unhooked.

The bolting and unbolting mechanism comprises at least first and second hooks 15, 16 carried by the cover and arranged to be bolted respectively by first 13 and second 14 bolts which are opposite each other and carried by the first and second spars 1, 2. The bolting mechanism can also comprise third 15' and fourth 16' hooks arranged to be bolted respectively by third 13' and fourth 14' bolts which are opposite each other and also carried by the first and second longitudinal spars 1, 2.

The invention also relates to a bracelet equipped with a clasp according to the invention.

The invention also relates to a watch equipped with a clasp according to the invention.

The invention claimed is:

1. A bracelet clasp comprising:

a base element (10) whose first and second long sides are formed respectively of first (1) and second (2) spars, the base element (10) having first (11) and second (12) openings joined to the first (1) and second (2) spars such that the first and second spars form respective flexible members;

at least one leaflet (3, 4) which is pivotable and articulated on a first and/or a second short side of the base element (10); and at least one cover (5, 6) pivoting and articulated on the at least one leaflet (3, 4), the at least one cover (5, 6) including a bolting and unbolting mechanism, the at least one cover being arranged to be folded over the base element (10) and maintained thereon in response to the flexible members being engaged with the bolting and unbolting mechanism so that the at least one cover (5, 6) is removably hooked to the base element (10), wherein a pressure exerted simultaneously on each of the spars (1, 2) in a direction transverse to the clasp leading to an elastic deformation of the spars (1, 2) and to disengaging of the at least one cover (5, 6) from the base element (10) to allow a wearer to open the clasp.

2. The clasp according to claim 1, wherein the bolting and unbolting mechanism comprises at least first (15) and second (16) hooks carried by the at least one cover (5, 6), the at least first (15) and second (16) hooks being arranged to be clipped respectively on at least first (13) and second (14) bolts carried by the first (1) and second (2) spars.

3. The clasp according to claim 2, wherein the first (1) and second (2) spars respectively carry first (7) and second (8) push-pieces.

4. The clasp according to claim 3, wherein the first (13) bolt and a third (13') bolt are placed on either side of the first push-piece (7), and the second (14) bolt and a fourth (14') bolt are placed on either side of the second push-piece (8).

5. The clasp according to claim 4, wherein the first (11) and second (12) openings have a length less than a length of the base element (10) and greater than a total length of the push-pieces and the bolts.

6. The clasp according to claim 4, wherein the first (15), second (16), third (13') and fourth (14') bolts, and the first (7) and second (8) push-pieces form an element in one-piece with the base element (10).

7. The clasp according to claim 3, further comprising support elements (7', 8') disposed on the spars (1, 2) and arranged to cooperate with ribs (17, 18) when pressure is exerted on the push-pieces (7, 8), so as to limit a maximum travel for the push-pieces and limit a deformation of the spars so as not to exceed a plastic deformation threshold.

8. The clasp according to claim 7, wherein the ribs (17, 18) are integral with the base element (10) and formed in an immediate vicinity of the openings (11, 12).

9. The clasp according to claim 7, wherein the support elements (7', 8') are integral with the spars and placed on a back of the push-pieces (7, 8).

10. The clasp according to claim 7, wherein the support elements (7', 8') each have a lower inclined plane (80, 81) oriented towards an inside of the clasp, the lower inclined plane (80, 81) being arranged to cooperate with the ribs (17, 18).

11. The clasp according to claim 7, wherein the support elements (7', 8') each comprise an upper inclined plane (82, 83) oriented towards an outside of the clasp and arranged to cooperate with the at least one cover (5, 6).

12. The clasp according to claim 1, wherein the base element (10), the first (3) and second leaflets (4), and first (5) and second (6) covers are made of a ceramic-filled plastic material.

* * * * *